US005394809A

United States Patent [19]

Feldpausch et al.

[11] Patent Number: 5,394,809

[45] Date of Patent: Mar. 7, 1995

[54] ADJUSTABLE HEIGHT TABLE

[75] Inventors: Stephen J. Feldpausch, Hastings; David E. Wright, Grand Rapids, both of Mich.

[73] Assignee: Steelcase Inc., Grand Rapids, Mich.

[21] Appl. No.: 56,478

[22] Filed: May 3, 1993

[51] Int. Cl.[6] ..... A47B 9/00

[52] U.S. Cl. ..... 108/144; 108/50

[58] Field of Search ..... 108/144, 50, 106, 107, 108/146, 147; 248/188.6

[56] References Cited

U.S. PATENT DOCUMENTS

| | | | |
|---|---|---|---|
| Re. 27,160 | 8/1971 | Ferdinand et al. . | |
| 496,739 | 5/1893 | Kennedy . | |
| 545,438 | 9/1895 | Allen . | |
| 743,211 | 11/1903 | Alexander . | |
| 761,468 | 5/1904 | Ford . | |
| 793,996 | 7/1905 | De Leon . | |
| 820,336 | 5/1906 | Bancroft . | |
| 1,501,088 | 7/1924 | Anderson . | |
| 1,610,730 | 12/1926 | Baler . | |
| 1,685,445 | 9/1928 | Bash . | |
| 2,086,026 | 7/1937 | Gedris . | |
| 2,425,263 | 8/1947 | Niver . | |
| 2,435,060 | 1/1948 | Thomson . | |
| 2,662,680 | 12/1953 | Bronson . | |
| 3,309,050 | 3/1967 | Blink et al. . | |
| 3,503,390 | 3/1970 | Peters . | |
| 3,701,506 | 10/1972 | Favreau | 108/144 X |
| 3,855,946 | 12/1974 | Bales . | |
| 3,875,872 | 4/1975 | Kayner . | |
| 3,960,406 | 6/1976 | Buker . | |
| 4,165,856 | 8/1979 | Wiseheart . | |
| 4,378,173 | 3/1983 | Hopwell . | |
| 4,632,349 | 12/1986 | Anstey . | |
| 4,667,605 | 5/1987 | Bastian | 108/144 |
| 4,676,491 | 6/1987 | Radlof . | |
| 4,762,072 | 8/1988 | Boundy et al. | 108/50 |
| 4,785,742 | 11/1988 | Esslinger | 108/147 X |
| 4,884,513 | 12/1989 | Newhouse et al. | 108/50 |
| 4,921,367 | 5/1990 | Everett, II et al. . | |
| 5,024,167 | 6/1991 | Hayward | 108/50 |
| 5,078,534 | 1/1992 | White . | |
| 5,107,775 | 4/1992 | Langlais et al. . | |
| 5,197,393 | 3/1993 | Yeakle | 108/147 X |
| 5,224,429 | 7/1993 | Borgman et al. | 108/147 |

*Primary Examiner*—Jose V. Chen

*Attorney, Agent, or Firm*—Price, Heneveld, Cooper, Dewitt & Litton

[57] ABSTRACT

An adjustable height table is provided including a panel forming a worksurface, and a pair of telescopingly adjustable legs attached to the panel for supporting the panel. Each telescopingly adjustable leg includes a first member connected to the panel and a second member slidingly engaging the first member and extendable from the first member. Apertures in the first and second members align as the worksurface is positioned at each of a plurality of selectable heights. The apertures are irregular in shape, and an L-shaped locking pin is extendable through the apertures and axially rotatable so that the locking pin is securely lockingly engages the apertures to thus securely hold the adjustable leg in a desired selectable height. One or more C-shaped covers is releasably attached onto the telescopingly adjustable leg, one of the covers when assembled to the leg preventing inadvertent dislodgement of the locking pin.

18 Claims, 5 Drawing Sheets

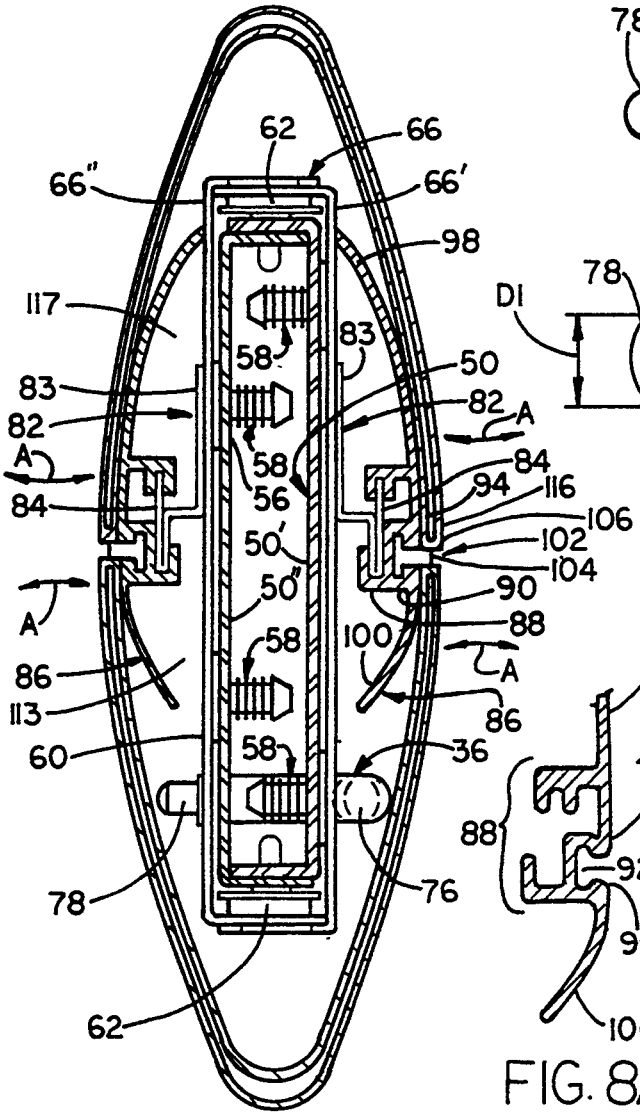
FIG. 8
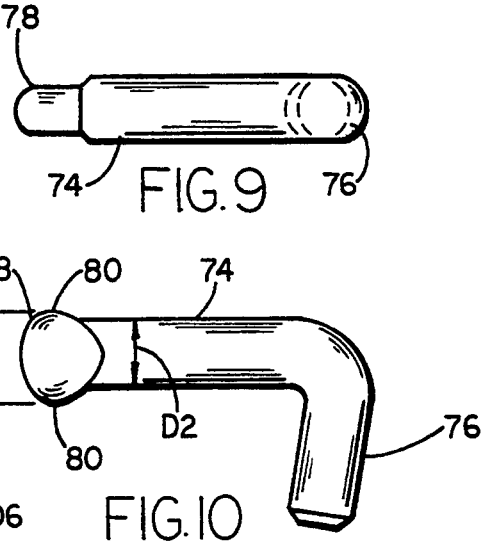
FIG. 9
FIG. 10
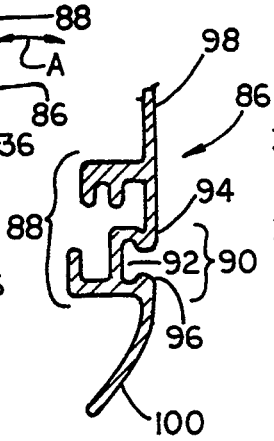
FIG. 8A
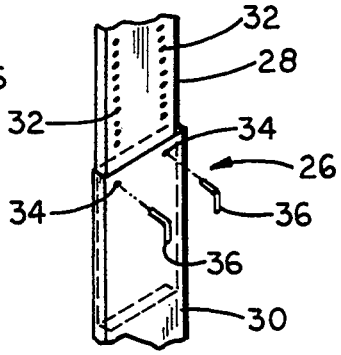
FIG. 6
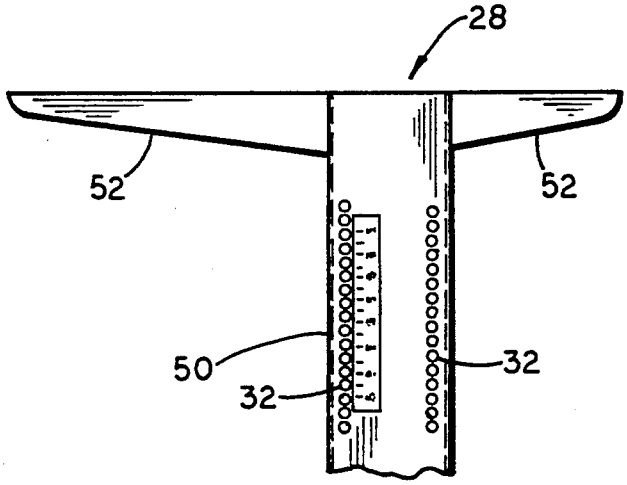
FIG. 7

ADJUSTABLE HEIGHT TABLE

BACKGROUND OF THE INVENTION

The present invention relates to furniture, and in particular to a vertically adjustable leg construction therefor.

Vertically adjustable furniture units, such as worksurfaces, computer stands, etc. are particularly advantageous where an optimum worksurface level may vary. For example, it may be desirable for an engineer or technical worker to do some work while sitting and other work while standing. Many devices have been designed for vertical adjustability, however improvements are desired in the simplicity, utility, and safety of the vertically adjustable mechanism while still maintaining aesthetics.

SUMMARY OF THE INVENTION

One aspect of the present invention is to provide a vertically adjustable article of furniture having a telescoping leg construction that can be manually adjusted to a desired height, locked at the desired height by a locking means, and aesthetically covered by a removable cover that securely holds the locking means in place when the cover is assembled onto the leg. The article of furniture includes a furniture unit, and at least one telescopingly adjustable leg attached to the furniture unit for supporting same. The telescopingly adjustable leg includes a first member, and a second member slidingly engaging the first member and extendable from the first member. A mechanically releasable lock is provided for interconnecting the first and second members together in a selected extended position. A cover is releasably attached to the telescopingly adjustable leg, the cover when attached preventing inadvertent dislodgement of the mechanically releasable lock.

In the preferred form, the mechanically releasable lock includes irregularly shaped apertures in the first and second members that are alignable, and further includes a locking pin that can be inserted into a pair of aligned apertures and rotated to lockingly engage the pair of aligned apertures. The covers when attached then provide a double safety feature by preventing inadvertent dislodgement of the locking pin even if the locking pin becomes loosened.

These and other features, advantages and objects of the present invention will be further understood and appreciated by those skilled in the art by reference to the following specification, claims and appended drawings.

BRIEF DESCRIPTION OF THE DRAWINGS

FIG. 6 is a fragmentary perspective view of one of the telescoping legs of the table with the covers removed;

FIG. 7 is a side view of the upper member of a telescoping leg;

FIG. 8 is a cross-sectional view taken along the plane VIII—VIII in FIG. 3;

FIG. 8A is a cross-sectional view of the extrusion shown in FIG. 8;

FIGS. 9–10 are orthogonal views of the locking pin;

DETAILED DESCRIPTION OF THE PREFERRED EMBODIMENTS

Figure 5:
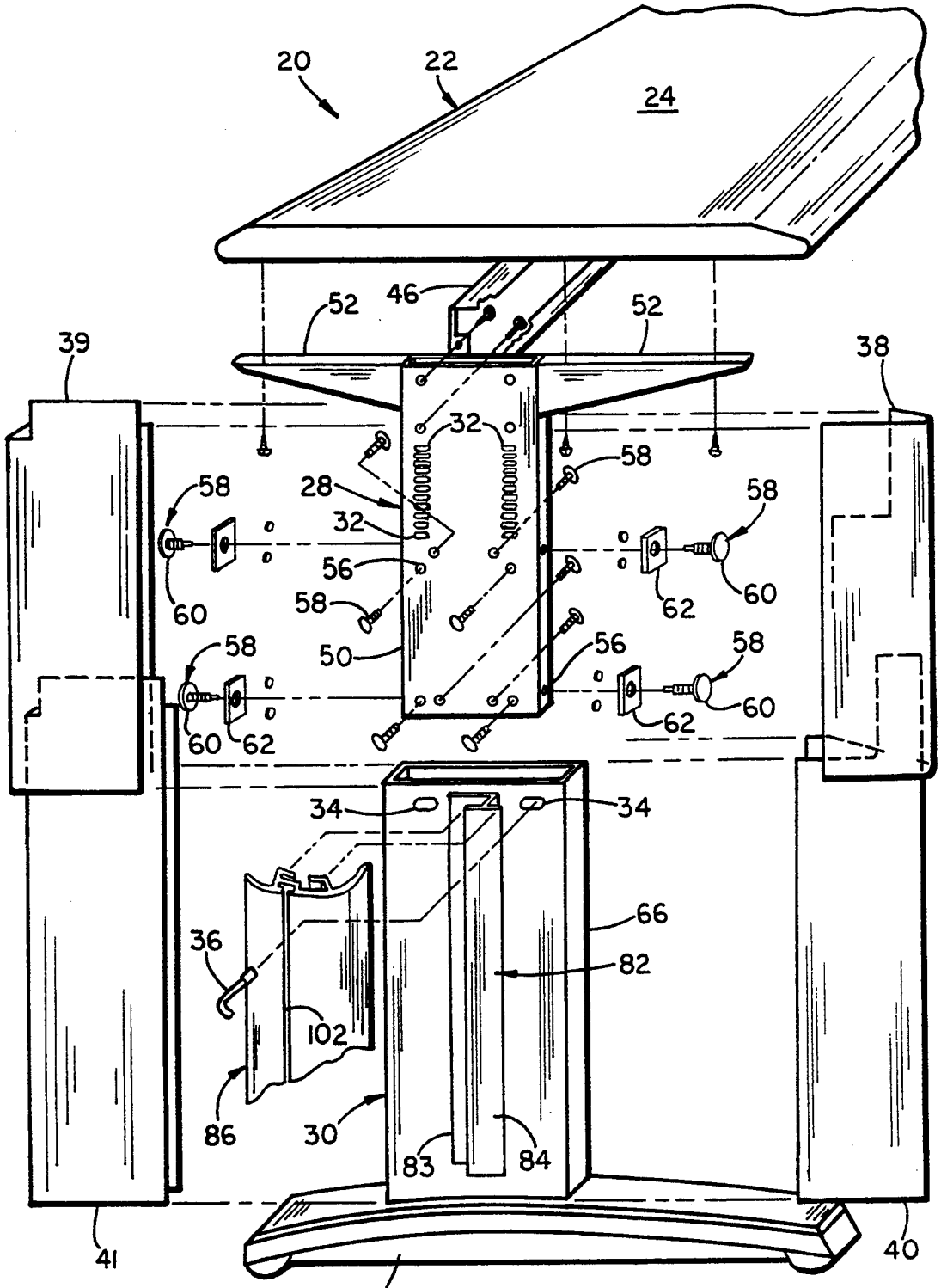
FIG. 5 is an exploded perspective view of the table illustrated in FIG. 1.

An adjustable height table 20 embodying the present invention is illustrated in FIGS. 1–4. Table 20 includes a horizontal panel-like member or furniture unit 22 forming a worksurface 24, panel 22 being supported on a pair of spaced apart telescopingly adjustable legs 26. The legs 26 include an upper member 28 attached to panel 22 and a lower member 30 telescopingly engaging upper member 28. Leg members 28 and 30 include a plurality of apertures 32 and 34 (FIG. 5) for receiving a locking pin 36 to secure the members 28 and 30 in a selected extended position, thus providing the vertical adjustability. C-shaped covers 38, 39, 40 and 41 frictionally snap-lock onto opposing sides of members 30 to aesthetically cover legs 26. The covers 38–41 also provide increased safety by securely abuttingly retaining locking pin 36 within apertures 32 and 34, and also provide utility by providing a readily accessible channel 42 for retaining wiring and/or cabling 44 routed to the worksurface 24 or to a wire management channel 46 located under the panel 22.

Figure 11:
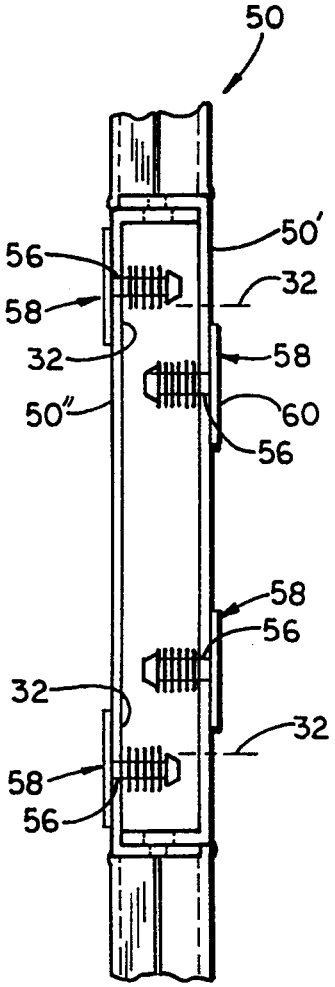
FIG. 11 is a cross-sectional view of the upper member of a telescoping leg.

Upper member 28 (FIG. 5) includes a box-shaped post section 50 comprised of two C-shaped channels 50' and 50'' welded together (see FIGS. 8 and 11), and further includes worksurface attachment brackets 52 attached to the top of post section 50 for securely attaching to panel 22. Apertures 32 are located in the sides of post section 50 and extend through both post channels 50' and 50''. Apertures 32 are sized to receive locking pin 36. Two vertical rows of apertures 32 are located symmetrically on post section 50 and extend fully through post section 50. This facilitates manufacture of post section 50 by providing a part that cannot be assembled backwards, and also allows use of two locking pins 36 such as for supporting a higher load on panel 22. Notably, locking pins 36 can be inserted into apertures 32 from either direction. Second type apertures 56 are also provided on all four sides of upper member 28 for receiving push-in bearings 58 with enlarged heads 60. Bearing heads 60 provide for low friction sliding engagement of upper member 28. Bearing pads 62 are used on the short sides of upper member 28 to add some compressibility characteristic to the bearings 58 for increased stability and reduced binding when extending/retracting the telescoping legs 26.

Lower member 30 (FIG. 5) includes a box-shaped post section 66 comprised of two C-shaped channels 66' and 66'' welded together (see FIG. 8), and further includes a foot section 68 (FIG. 5) for stably engaging a support surface such as a building floor. A pair of shaped apertures 34 are located in the sides of post section 66 and extend through both of post channels 66' and 66''. Apertures 32 and 34 are shaped to operably receive locking pin 36 so that pin 36 can be extended through aligned pairs of apertures 32 and 34 and then axially rotated 90° to lock pin 36 in place. A plurality of apertures 32 are provided so that as upper member 28 is extended/retracted into lower member 30 it can be selectively positioned in lower member 30 with a selected pair of apertures 32 aligning with apertures 34. Thus, one or two locking pins 36 can be extended through the aligned apertures 32 and 34 to secure worksurface 24 at the desired selected height (FIG. 6).

Locking pin 36 (FIGS. 9 and 10) is L-shaped and includes a shaft 74 and a laterally bent portion forming a handle 76. Shaft 74 has a deformed end 78 that is flattened to provide an enlarged dimension D1 greater than the diameter D2 of shaft 74, thus forming protrusions 80. Apertures 32 and 34 are large enough to receive deformed end 78 and are shaped oblong so that when locking pin 36 is rotated 90° after installation, protrusions 80 lockingly engage material forming the narrow dimension of shaped the apertures. Thus, locking pin 36 and apertures 32 and 34 form a manually releasable lock for interconnecting first and second members in a selected extended position. Notably, it is contemplated that protrusions 80 and deformed end 78 can be any of a number of different shapes.

An elongate bracket 82 (FIG. 8) is spot-welded or otherwise secured to the outer sides of lower member 30. Elongate bracket 82 includes a tail section 83 which is the portion spot-welded to lower member 30, and further includes a T-shaped portion 84 that extends outwardly. An extrusion 86 (FIG. 8A) includes an inner portion 88 configured to mateably engage T-shaped portion 84, and further includes an outer portion 90 defining a channel 92 between ridges 94 and 96 extending along the length of extrusion 86. Elongate flanges 98 and 100 extend arcuately away from channel 92. An elongate T-shaped side extrusion 102 is adapted to fit into channel 92 so that a thin strip of material 104 is exposed, the thin strip providing primarily an aesthetic function, but also providing a stop for the covers 38–41 during assembly. A depression 106 is defined between thin strip 104 and ridge 94, and a second depression 106 is defined between thin strip 104 and ridge 96.

Figure 1:
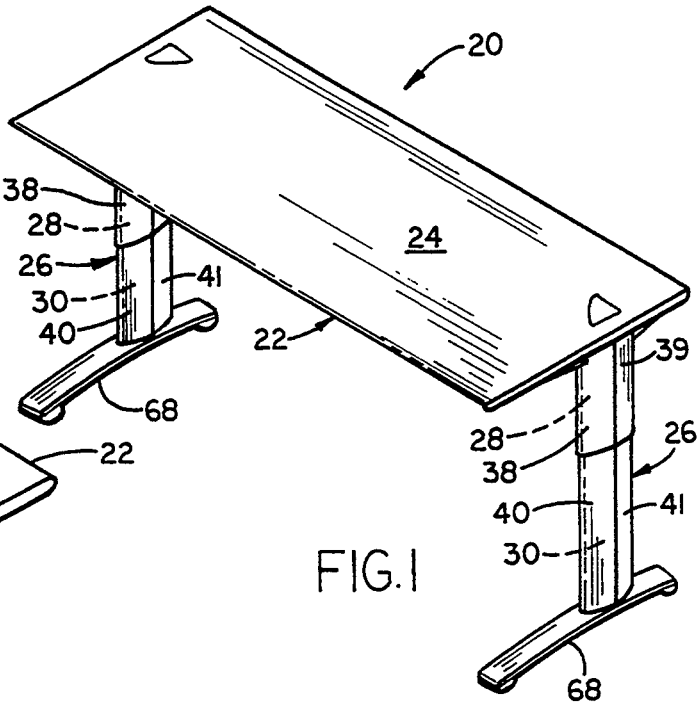
FIG. 1 is a perspective view of an adjustable height table embodying the present invention.
Figure 2:
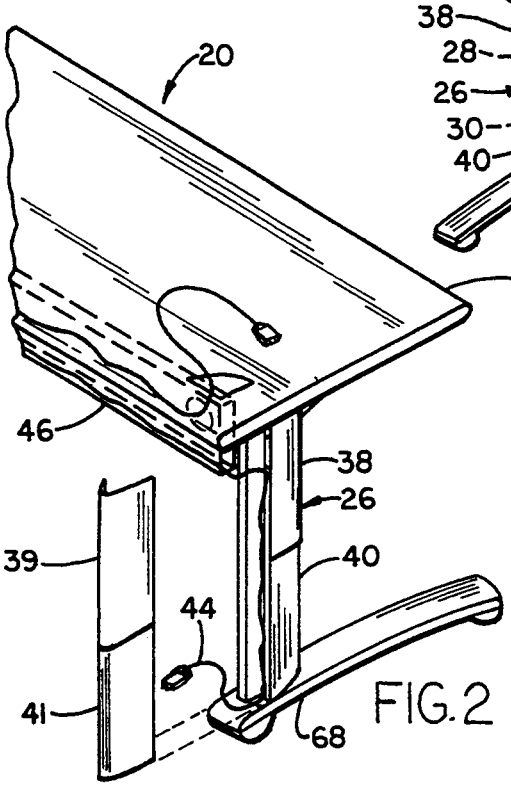
FIG. 2 is a perspective view of the table illustrated in FIG. 1 with a pair of the covers on one side exploded away.
Figure 3:
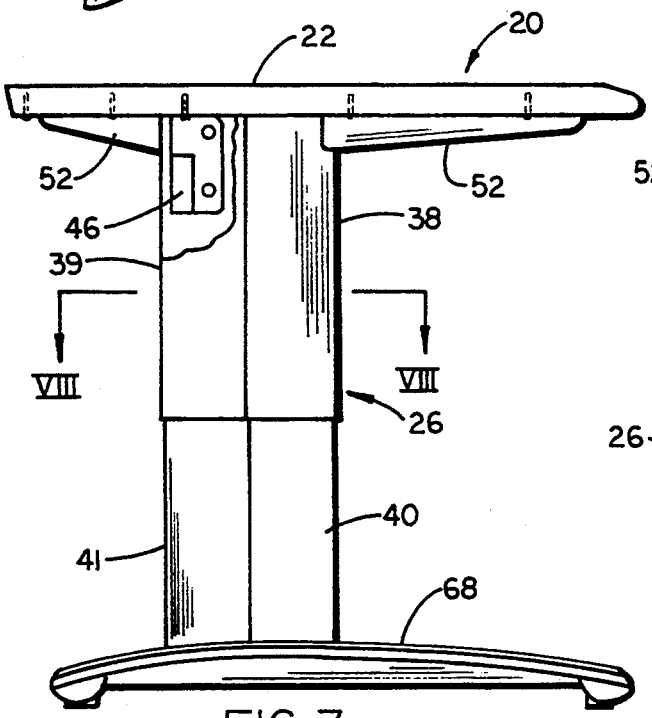
FIG. 3 is a partially broken-away side view of the table illustrated in FIG. 1.
Figure 4:
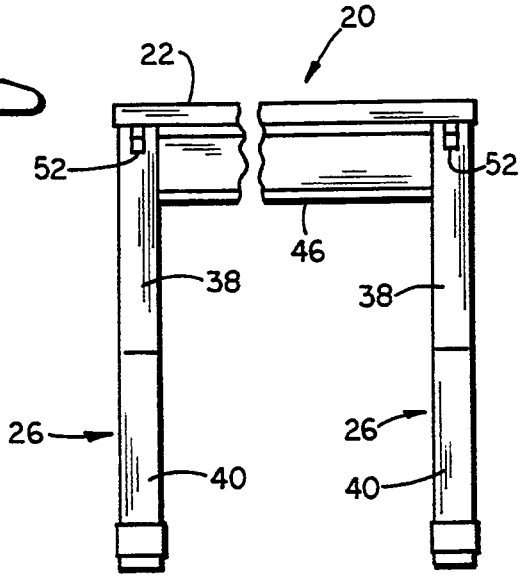
FIG. 4 is a front view of the table illustrated in FIG. 1.
Figure 12:
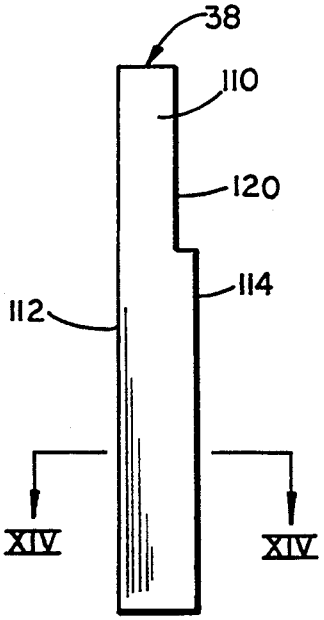
FIGS. 12–13 are orthogonal views of one of the covers.
Figure 13:
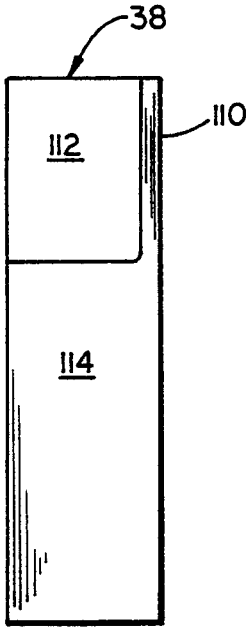
Figure 14:
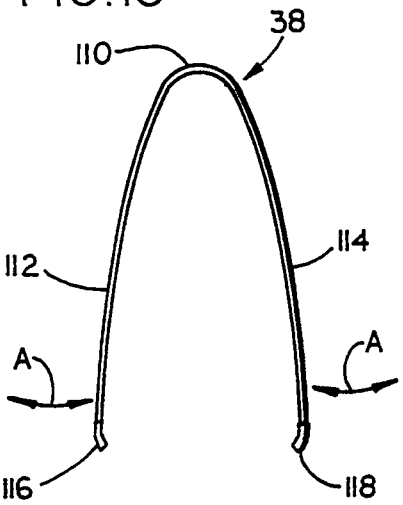
FIG. 14 is a cross-sectional view taken along the plane XIV—XIV in FIG. 12.

The shape of the four C-shaped covers 38–41 can be best understood by reviewing cover 38 shown in FIGS. 12–14. Cover 38 (like covers 39–41) includes a C-shaped cross section (FIG. 14) having an arcuate central section 110 and opposing curvilinear wing sections 112 and 114. The outer edges 116 and 118 of wing sections 112 and 114, respectively, are bent inwardly to form flanges for engaging depressions 106 on opposing sides of lower member 30. Edges 116 and 118 are preferably coated or include a C-shaped extrusion along their terminal edge to prevent scratching as covers 38–39 are installed or removed. Wing sections 112 and 114 are notched as required for clearance for worksurface attachment brackets 52 on upper member 28 or foot sections 68 on lower member 30, and include notches such as the notch 120 shown (FIG. 12). As illustrated in FIGS. 8 and 14, covers 38–41 resiliently flex in direction A and snap-lock onto the respective leg 26 as cover edges 116 and 118 engage depressions 106 and 108. The arrangement allows upper and lower covers 38–41 to telescopingly slide over each other as the legs 26 are extended/retracted. Notably, cover wing portions 112 and 114 and extrusion flanges 98 and 100 form a protected channel 113 (FIG. 8) within telescoping legs 26 for receiving wiring and cabling 44 therethrough (FIG. 2). Also, covers 38–41 and extrusion 86 form a protected second channel 117 with leg members 28/30 (FIG. 8) thus creating a separate channel for receiving wiring and cabling therethrough.

As shown in FIG. 8, wing portions 112 and 114 are positioned proximate and close to the ends of locking pin 36. Thus, with covers 38–41 installed, locking pin 36 is prevented from inadvertent dislodgement even if locking pin 36 accidently rotates 90° or otherwise becomes loosened. In other words, cover wing sections 112 and/or 114 prevent locking pin 36 from escaping from apertures 32 and 34. Notably, it is contemplated that the telescoping leg arrangement can be used to support any furniture unit, and it is not necessarily limited to a table or worksurface forming furniture article.

To adjust the height of worksurface 24, one or more of covers 38–41 are removed from telescoping legs 26 to expose locking pin(s) 36. Locking pin 36 is then rotated 90° so that the protrusions 80 on locking pin deformed end 78 release from shaped apertures 32 and 34. Locking pin 36 can then be removed from apertures 32 and 34 while the weight of panel 22 is supported. With locking pin 36 removed, panel 22 can be lifted to a new height (i.e. upper leg members 28 can be extended/retracted from lower leg members 30). Locking pin 36 is then inserted into newly aligned apertures 32 and 34, and rotated 90° to lock in place. Covers 38–41 are reinstalled so that covers 38–41 are positioned proximate the ends of locking pin 36 to prevent the accidental dislodgement of locking pin 36. Thus, panel 22 is securely held at the new height.

Another embodiment of an adjustable height table is illustrated in FIGS. 15–19 and is generally referred to as table 20A. Comparable features of table 20A to table 20 are denoted by use of comparable numbers but with the letter A added thereto. Table 20A is adapted for use at an extended height, such as for use when standing, and includes a modesty panel 126A which not only provides a visual screen under the table, but also provides increased stability to table 20A when the table is extended to a near maximum height.

In table 20A, the inside elongate bracket is modified to provide attachment for modesty panel 126A. Specifically, an elongate bracket 128A (FIG. 19) is used, bracket 128A including a U-shaped portion 130A with flanges 132A spot-welded to leg lower member 30A, and a double thick flange 134A extending laterally from U-shaped portion 130A. Flange 134A includes attachment holes 136A. An adapter bracket 138A (FIG. 18) includes a first flange 140A and a second flange 144A extending from first flange 138A, second flange 144A being adapted to engage an end of modesty panel 126A.

Modesty panel 126A extends the width of panel 22A and attaches to both 46A and to adapter bracket 128A. In particular, modesty panel 126A includes a configured end 146A with flanges thereon for engaging second flange 144A.

Figure 19:
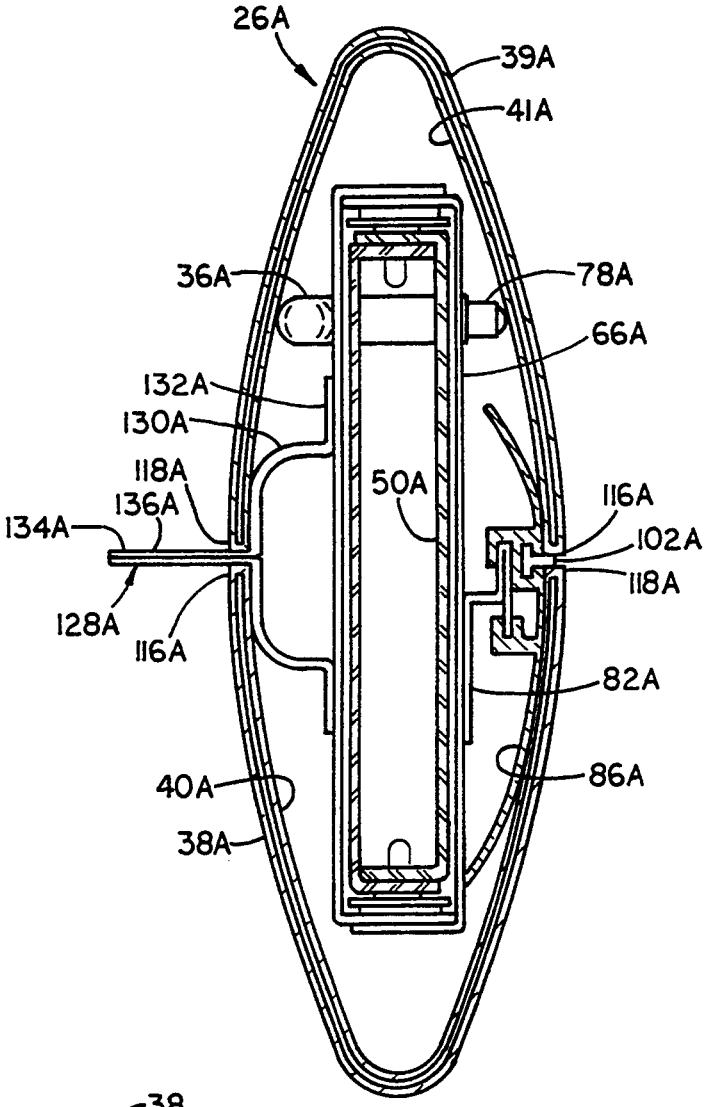
FIG. 19 is an enlarged cross-sectional view taken along the plane XIX—XIX in FIG. 15.
Figure 15:
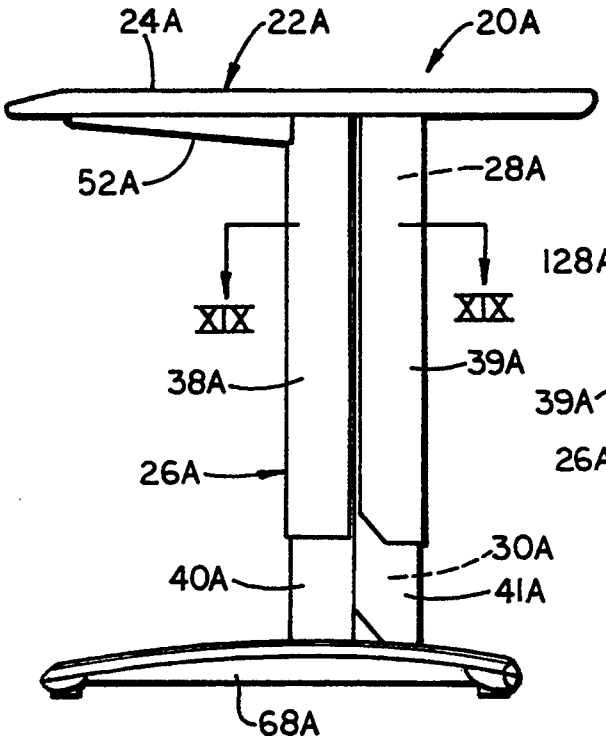
FIG. 15 is a side view of a modified adjustable height table embodying the present invention.
Figure 18:
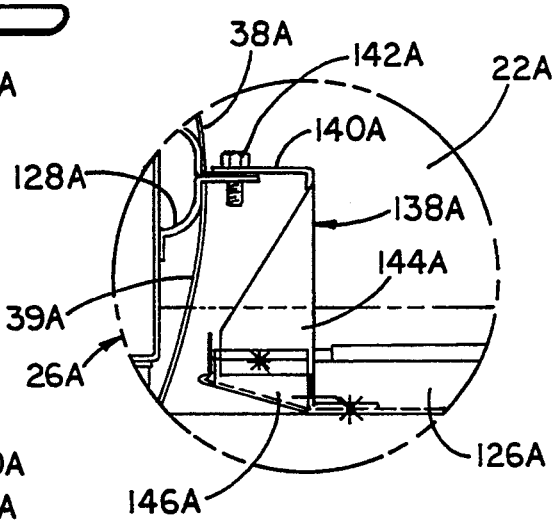
FIG. 18 is an enlarged view of the circled area labelled XVIII in FIG. 17.
Figure 16:
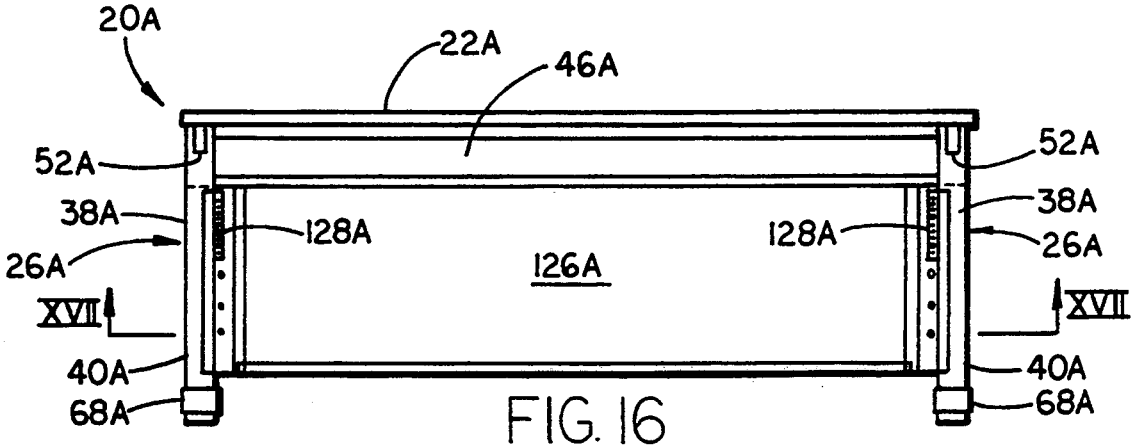
FIG. 16 is a front view of the modified table illustrated in FIG. 15.
Figure 17:
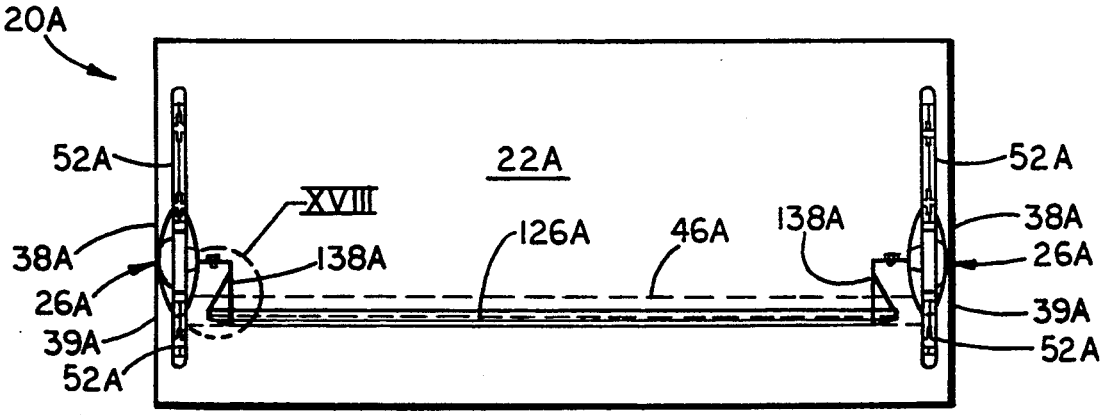
FIG. 17 is a bottom cross-sectional view of the modified table illustrated in FIG. 15.

Covers 38A–41A are elongated to fully cover telescopingly adjustable legs 26A (FIG. 15). As shown in FIG. 19, the U-shaped portion 130A of bracket 128A is dimensioned so that cover edges 116A and 118A securely frictionally engage leg 26A when installed. Bracket 128A may or may not include a depression for receiving the inner cover edge 116A/11SA. The act of vertically adjusting the height of table 20A is comparable to that of table 20.

Thus, there is presented an adjustable height table including a worksurface or furniture unit supported by telescopingly adjustable legs. The legs include upper and lower members that are slideably engageable and which include alignable apertures, and further include a locking pin that can be extended through selectively aligned apertures to securely hold the upper and lower members in an extended position. Covers are releasably installable on the telescoping legs, the covers aesthetically covering the legs and also preventing the locking pin from being inadvertently dislodged from the aperture legs, and still further the covers defining wire and cable management channels in the legs.

In the foregoing description it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. An article of furniture comprising:

a furniture unit;

a telescopingly adjustable leg attached to the furniture unit for supporting same, said telescopingly adjustable leg including a first member and a second member slidingly engaging said first member and extendable from said first member;

a manually releasable lock including ends and an intermediate section for interconnecting said first and second members in a selected extended position; and a C-shaped cover releasably attachable to said telescopingly adjustable leg, said cover having a first side section and an opposing second side section that cooperatingly engage opposing sides of said leg with said first and second side sections being positioned proximate the ends of said lock so that said cover when attached prevents inadvertent dislodgement of said manually releasable lock.

2. An article of furniture comprising:

a furniture unit;

a telescopingly adjustable leg attached to the furniture unit for supporting same, said telescopingly adjustable leg including a first member and a second member slidingly engaging said first member and extendable from said first member;

a manually releasable lock interconnecting said first and second members in a selected extended position;

a cover releasably attachable to said telescopingly adjustable leg, said cover when attached preventing inadvertent dislodgement of said manually releasable lock; and said manually releasable lock including apertures in said first and second members and a locking pin for lockingly engaging a selected pair of said apertures to hold said leg at a selected extended position.

3. An article as defined in claim 2 wherein said leg includes a depression and said cover includes edge means for releasably resiliently engaging said depression to retain said cover on said leg.

4. An article as defined in claim 3 wherein said cover includes opposing sides that fit partially around said leg to aesthetically cover same when installed thereon, one of said opposing sides being positioned proximate said locking pin to prevent inadvertent dislodgement of said locking pin from the selected pair of said apertures.

5. An article as defined in claim 4 wherein said cover is removable from said leg in a first direction and said locking pin is removable from said leg in a second direction perpendicular to said first direction.

6. An article of furniture comprising:

a furniture unit;

a telescopingly adjustable leg attached to the furniture unit for supporting same, said telescopingly adjustable leg including a first member and a second member slidingly engaging said first member and extendable from said first member;

a manually releasable lock interconnecting said first and second members in a selected extended position;

a cover releasably attachable to said telescopingly adjustable leg, said cover when attached preventing inadvertent dislodgement of said manually releasable lock;

said manually releasable lock including apertures in said first and second members and a locking pin for lockingly engaging a selected pair of said apertures to hold said leg at a selected extended position;

said leg includes a depression and said cover includes edge means for releasably resiliently engaging said depression to retain said cover on said leg;

said cover including opposing sides that fit partially around said leg to aesthetically cover same when installed thereon, one of said opposing sides being positioned proximate said locking pin to prevent inadvertent dislodgement of said locking pin from the selected pair of said apertures;

said cover being removable from said leg in a first direction and said locking pin is removable from said leg in a second direction perpendicular to said first direction; and a second cover positionable on said leg on an opposite side of said leg from said first cover, some of said apertures being covered by said first cover and others of said apertures being covered by said second cover, whereby one of said covers abuttingly retains said locking pin in the selected pair of apertures regardless of which of said apertures are selected.

7. An article as defined in claim 2 wherein said locking pin includes a shaft for extending through the selected pair of said apertures and a head for abutting a material forming one of said selected pair of said apertures.

8. An article as defined in claim 7 wherein said apertures in one of said members have an irregular shape, and said shaft includes a deformed end adapted to slide through said irregular shape and lock therein when axially rotated.

9. An article as defined in claim 7 wherein said locking pin is L-shaped.

10. An article as defined in claim 1 including a pair of said legs spaced apart and adapted to stably engage a support surface.

11. An article as defined in claim 10 including a modesty panel, and said first member of each telescoping leg includes a bracket for attaching the modesty panel thereto.

12. An article as defined in claim 11 wherein said furniture unit defines a worksurface and said legs are adjustable for positioning said worksurface for use at a standing height or a sitting height.

13. An article as defined in claim 1 including a pair of said legs and a pair of said covers for covering same, said pair of legs and covers forming assemblies each having an oblong cross-sectional shape and defining channels for retaining wiring and cabling therein.

14. An article as defined in claim 1 wherein one of said members includes a depression, and said cover includes an edge that snap-locks into said depression during installation.

15. An article of office furniture comprising:

a furniture unit;

a telescoping leg for supporting said furniture unit, said telescoping leg including an upper member connected to said furniture unit and a lower member telescopingly engaging said upper member, one of said upper and lower members including a first aperture and the other of said upper and lower members including a plurality of second apertures, said upper member being selectively positionable on said lower member so that a selected second aperture aligns with said first aperture when said furniture unit is positioned at a selected height;

a locking pin engageable with said first aperture and said selected second aperture to secure said telescoping leg in a given selected position and thus to secure said furniture unit at the selected height; and a removable C-shaped cover adapted to aesthetically cover at least a part of opposing sides of said telescoping leg, said cover being resiliently engageable with said telescoping leg and when installed forming a guard that prevents inadvertent dislodgement of said locking pin.

16. An article as defined in claim 15 wherein said locking pin is L-shaped and wherein said apertures in one of said members have an irregular shape, said shaft including a deformed end adapted to slide through said irregular shape and lock therein when said locking pin is axially rotated.

17. An article of office furniture comprising:

a furniture unit;

a telescoping leg for supporting said furniture unit, said telescoping leg including an upper member connected to said furniture unit and a lower member telescopingly engaging said upper member, one of said upper and lower members including a first aperture and the other of said upper and lower members including a plurality of second apertures, said upper member being selectively positionable on said lower member so that a selected second aperture aligns with said first aperture when said furniture unit is positioned at a selected height;

a locking pin engageable with said first aperture and said selected second aperture to secure said telescoping leg in a given selected position and thus to secure said furniture unit at the selected height;

a removable cover adapted to aesthetically cover at least a part of said telescoping leg, said cover being installable on said telescoping leg and when installed forming a guard that prevents inadvertent dislodgement of said locking pin;

said locking pin being L-shaped and said apertures in one of said members having an irregular shape, said shaft including a deformed end adapted to slide through said irregular shape and lock therein when said locking pin is axially rotated: and a second cover positionable on said leg on an opposite side of said leg from said first cover, some of said apertures being covered by said first cover and others of said apertures being covered by said second cover, whereby one of said covers abuttingly retains said locking pin in the selected pair of apertures regardless of which of said apertures are selected.

18. A table comprising:

a panel member defining a worksurface;

at least one adjustable leg connected to the panel member for supporting same, said adjustable leg including an upper member and a lower member, said upper member being slideably adjustable on said lower member so that said worksurface is selectively positionable at one of a plurality of selectable heights, said upper and lower members including apertures at least one pair of which align when said worksurface is at each of the plurality of selectable heights;

an L-shaped locking pin including a shaft engageable with a selectively aligned pair of said apertures to secure said upper and lower members together with said worksurface at a selected height, said shaft including a deformed end adapted to slide through said selectively aligned pair of apertures and lock therein when axially rotated; and a C-shaped cover resiliently releasably attachable to said adjustable leg, said cover when attached forming a guard covering an end of said locking pin and positioned proximate thereto that prevents inadvertent dislodgement of the locking pin.

* * * * *